US007227299B2

(12) United States Patent
Shimamura

(10) Patent No.: US 7,227,299 B2
(45) Date of Patent: Jun. 5, 2007

(54) COLOR CATHODE-RAY TUBE

(75) Inventor: Takayuki Shimamura, Kobe (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 230 days.

(21) Appl. No.: 11/038,609

(22) Filed: Jan. 18, 2005

(65) Prior Publication Data

US 2005/0174033 A1 Aug. 11, 2005

(30) Foreign Application Priority Data

Feb. 10, 2004 (JP) ..... 2004-033893

(51) Int. Cl.
*H01J 29/80* (2006.01)

(52) U.S. Cl. ..... 313/404; 313/402

(58) Field of Classification Search ..... 313/402–406; 267/158–160

See application file for complete search history.

(56) References Cited

U.S. PATENT DOCUMENTS

| | | | | |
|---|---|---|---|---|
| 3,617,787 | A * | 11/1971 | Plukker | 313/405 |
| 4,012,661 | A * | 3/1977 | Danielson et al. | 313/405 |
| 4,491,763 | A * | 1/1985 | Fujinuma et al. | 313/405 |
| 5,210,459 | A * | 5/1993 | Lee | 313/406 |
| 6,037,709 | A * | 3/2000 | Nakagawa et al. | 313/404 |
| 6,288,480 | B1 * | 9/2001 | Takano et al. | 313/407 |
| 6,573,646 | B2 * | 6/2003 | Seo | 313/407 |
| 7,045,940 | B2 * | 5/2006 | Ko et al. | 313/402 |
| 2003/0057818 | A1 * | 3/2003 | Ito | 313/404 |
| 2003/0102795 | A1 * | 6/2003 | Etou | 313/407 |

FOREIGN PATENT DOCUMENTS

| | | |
|---|---|---|
| JP | 6-44916 | 2/1994 |
| JP | 8-162032 | 6/1996 |

* cited by examiner

*Primary Examiner*—Ashok Patel
*Assistant Examiner*—Christopher M. Raabe
(74) *Attorney, Agent, or Firm*—Hamre, Schumann, Mueller & Larson, P.C.

(57) ABSTRACT

A shadow mask structure is held on a panel via a support member in which a base member and a spring member are connected to each other in a substantially V-shape. The spring member includes a connecting portion connected to the base member, an engagement portion having an engagement hole in which a stud pin is fitted, and an elastic portion between the connecting portion and the engagement portion, tilted with respect to the base member and mainly having a spring function. Assuming that a width of an end of the elastic portion on the connecting portion side is A, a width of an end of the elastic portion on the engagement portion side is B, a width of a narrowest part of the elastic portion in a region including both the ends is C, and a minimum value of an effective width of the elastic portion in the region including both the ends is C', relationships: A>C and B>C, and 0.40<C'/A<0.55 are satisfied. Because of this, the plastic deformation of the spring member under the application of an external impact thereto can be reduced, so that color displacement on a screen attributable to mislanding can be reduced.

4 Claims, 7 Drawing Sheets

COLOR CATHODE-RAY TUBE

BACKGROUND OF THE INVENTION

1. Field of the Invention

The present invention relates to a color cathode-ray tube.

2. Description of the Related Art

When a color cathode-ray tube is operated, an electron beam strikes a shadow mask (color selection electrode), and the shadow mask and a frame holding the shadow mask expand thermally, whereby an aperture on the shadow mask moves slightly toward a circumferential edge of the shadow mask. Consequently, the relative position between the aperture and a phosphor surface formed on a panel is changed and causes color displacement on a screen. In order to correct the color displacement, a support mechanism for fixing the shadow mask to the panel generally is provided with a function of correcting a change in position of the aperture of the shadow mask.

As the support mechanism, a substantially V-shaped support mechanism has been used conventionally. During thermal expansion of the shadow mask and the like, a spring member of the substantially V-shaped support mechanism is deformed so that the shadow mask approaches the phosphor surface side. Therefore, color displacement attributable to a change in position of the aperture of the shadow mask can be prevented. Furthermore, there is no problem that the shadow mask is rotated, for example, as in the case of using an elongated plate-shaped spring composed of two kinds of metals called a bimetal spring.

However, the substantially V-shaped support mechanism is likely to be deformed or to come off a stud pin when an external impact attributable to dropping or the like is applied to a cathode-ray tube, compared with the bimetal spring. In order to solve this problem, an attempt has been made to improve the material for the spring member (e.g., see JP6(1994)-44916A).

Recently, in a color cathode-ray tube, a panel on which an image is to be displayed is flattened since the flat panel reduces the reflection of external light and enhances the appearance. Along with this, as a shadow mask having a function of color selection, the one welded to a frame under the application of tension has come into use in place of a press-type shadow mask. A shadow mask structure provided with such a so-called tension-type shadow mask has a large weight so as to maintain the mechanical strength required for withstanding a tensile strength. Thus, there is a problem that sufficient strength against an external impact cannot be ensured merely by improving the material for the spring member. In particular, when an external impact is applied in a direction parallel to a long side direction of a screen, the spring member is likely to be deformed plastically. When the spring member is deformed plastically, the relative position between the aperture of the shadow mask and the phosphor surface is changed and causes color displacement.

SUMMARY OF THE INVENTION

Therefore, with the foregoing in mind, it is an object of the present invention to provide a color cathode-ray tube excellent in impact resistance.

In order to achieve the above-mentioned object, a color cathode-ray tube of the present invention includes: a panel in which a phosphor surface is formed on an inner surface and a stud pin is fixed; a funnel connected to the panel; a shadow mask structure placed so as to be opposed to the phosphor surface; and a support mechanism for engaging the shadow mask structure with the stud pin. The support mechanism includes a base member and a spring member connected to each other in a substantially V-shape. The spring member includes a connecting portion connected to the base member, an engagement portion having an engagement hole in which the stud pin is fitted, and an elastic portion between the connecting portion and the engagement portion, tilted with respect to the base member and mainly having a spring function. Assuming that a width of an end of the elastic portion on the connecting portion side is A, a width of an end of the elastic portion on the engagement portion side is B, a width of a narrowest part of the elastic portion in a region including both the ends is C, and a minimum value of an effective width of the elastic portion in the region including both the ends is C', relationships: $A>C$ and $B \geqq C$, and $0.40<C'/A<0.55$ are satisfied.

These and other advantages of the present invention will become apparent to those skilled in the art upon reading and understanding the following detailed description with reference to the accompanying figures.

DESCRIPTION OF THE PREFERRED EMBODIMENTS

According to the present invention, when an external impact is applied, a stress applied to the elastic portion of the spring member is dispersed. Therefore, the plastic deformation of the spring member can be reduced, and consequently, color displacement on a screen that occurs due to mislanding can be reduced. Thus, a color cathode-ray tube excellent in impact resistance can be provided.

In the above-mentioned color cathode-ray tube of the present invention, it is preferable that a relationship: $B>C$ is satisfied. More specifically, it is preferable that the elastic portion includes a narrowest part at a position excluding the end on the connecting portion side and the end on the engagement portion side. According to this configuration, in the course of producing the color cathode-ray tube, the workability in attaching or detaching the shadow mask structure to the panel is enhanced.

Furthermore, it is preferable that, in a state where the shadow mask structure is mounted on the panel, a flexural height D of the elastic portion of the spring member is 12.5 mm or more. According to this configuration, the impact force applied to the spring member under the application of an external impact to the color cathode-ray tube can be decreased further, so that the plastic deformation of the spring member can be reduced further. Thus, the impact resistance of the color cathode-ray tube is enhanced further.

Hereinafter, the present invention will be described by way of illustrative embodiments with reference to the drawings.

Embodiment 1

Figure 1:
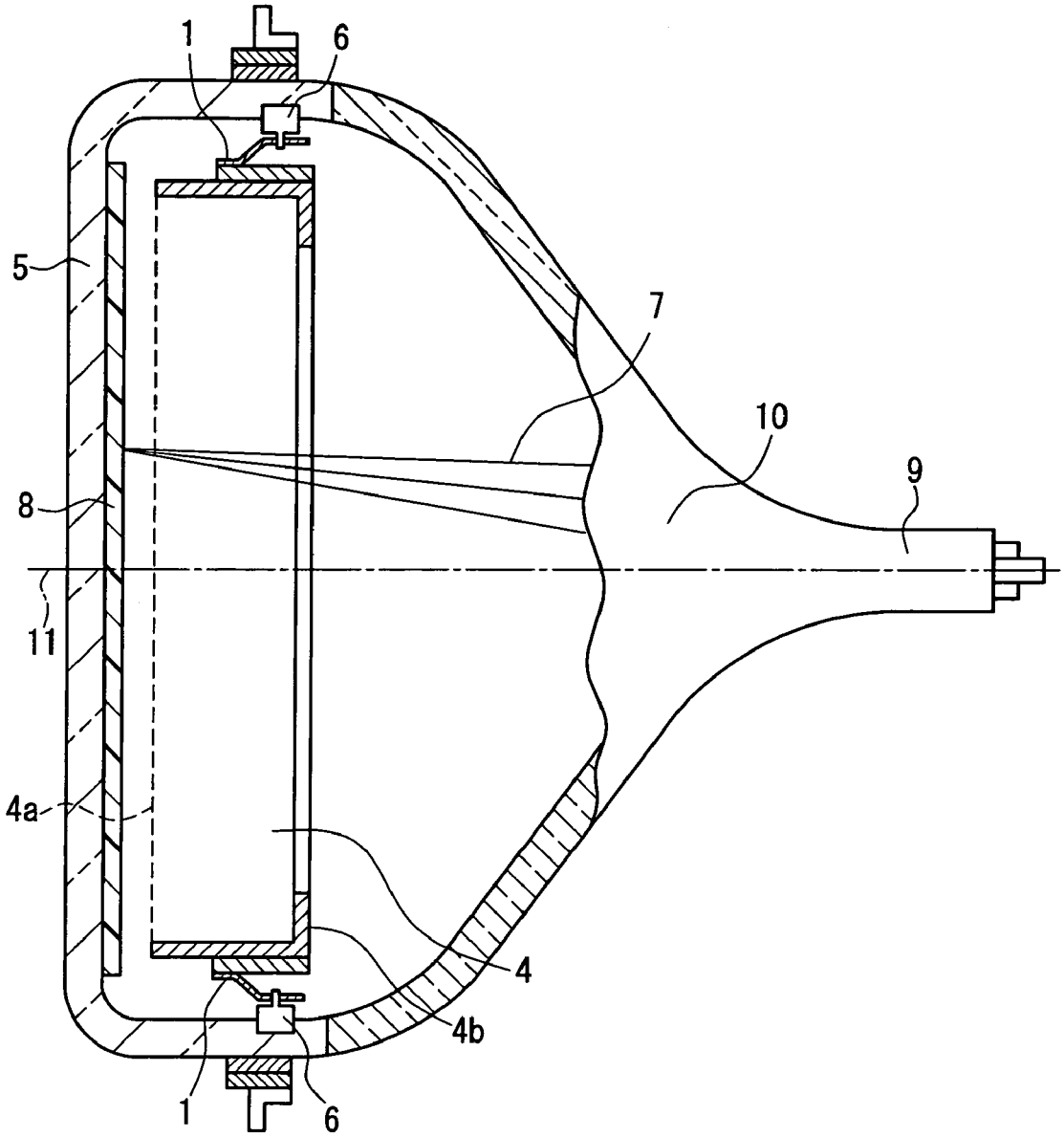
FIG. 1 is a schematic cross-sectional view of a color cathode-ray tube according to Embodiment 1 of the present invention.

FIG. 1 is a schematic cross-sectional view of a color cathode-ray tube according to Embodiment 1 of the present invention. The color cathode-ray tube of the present embodiment includes an envelope composed of a panel 5 and a funnel 10 connected to each other. An outer surface of an image display region of the panel 5 is substantially flat. On an inner surface of the panel 5, a phosphor surface 8 is formed. Reference numeral 4 denotes a shadow mask structure that is composed of a shadow mask 4*a* on which a number of apertures are formed and a substantially rectangular frame 4*b* supporting the shadow mask 4*a* while applying tension thereto. Support mechanisms 1 are attached to four corners of the frame 4*b*, and a stud pin 6 fixed on an inner surface of the panel 5 is fitted in and engaged with an engagement hole provided in each support mechanism 1, whereby the shadow mask structure 4 is fixed to the panel 5. An electron gun (not shown) is provided in a neck portion 9 of the funnel 10, and electron beams 7 emitted from the electron gun pass through the apertures of the shadow mask 4*a* and illuminate the phosphor surface 8 of the panel 5, whereby an image is displayed on a screen of the color cathode-ray tube. Reference numeral 11 denotes a tube axis that passes through substantially the center of the color cathode-ray tube.

Figure 2B:
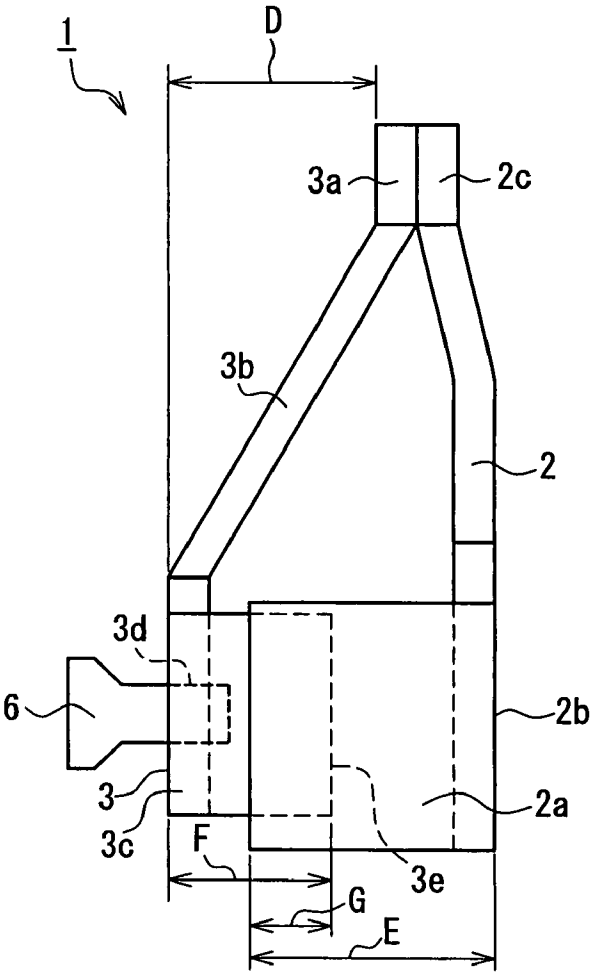
FIG. 2B is an enlarged side view thereof
Figure 2A:
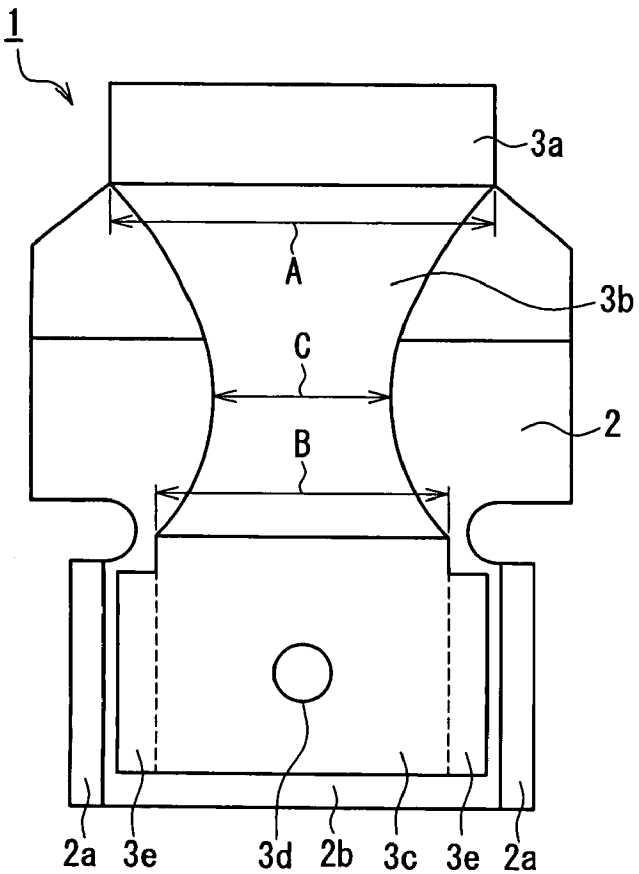
FIG. 2A is an enlarged front view of a support mechanism of the color cathode-ray tube according to Embodiment 1 of the present invention.

FIG. 2A shows an enlarged front view of the support mechanism 1 in the color cathode-ray tube of the present embodiment, and FIG. 2B shows an enlarged side view thereof. The support mechanism 1 is composed of a base member 2 and a spring member 3. The base member 2 includes a base portion 2*b* welded to the frame 4*b*, a pair of guide portions 2*a* formed so as to be connected to the base portion 2*b* and bent substantially vertically with respect to the base portion 2*b*, and a connecting portion 2*c* welded to the spring member 3. The spring member 3 is composed of a connecting portion 3*a* attached to the connecting portion 2*c* of the base member 2, an elastic portion 3*b* tilted with respect to the base portion 2*b* and mainly having a spring function, an engagement portion 3*c* having an engagement hole 3*d* in which the stud pin 6 is to be fitted, and a pair of guide portions 3*e* formed so as to be bent vertically with respect to the engagement portion 3*c*. As shown in FIG. 2B, the base member 2 and the spring member 3 are connected to each other so as to have a substantially V-shape when seen as a whole, due to the tilt of the elastic portion 3*b* with respect to the base portion 2*b*.

The pair of guide portions 3*e* of the spring member 3 are placed between the pair of guide portions 2*a* of the base member 2, and at least a part of the guide portion 2*a* is opposed to at least a part of the guide portion 3*e*. By providing the guide portions 2*a*, 3*e*, when an external impact is applied to the color cathode-ray tube, the guide portion 2*a* and the guide portion 3*e* interfere with each other, whereby the stress applied to the spring member 3 (in particular, the elastic portion 3*b*) can be reduced. Therefore, the amount of elastic deformation of the spring member 3 can be reduced, and consequently, the amount of color displacement of the color cathode-ray tube can be reduced.

As shown in FIG. 2A, assuming that a width of an end of the elastic portion 3*b* on the connecting portion 3*a* side is A, a width of an end of the elastic portion 3*b* on the engagement portion 3*c* side is B, and a width of a narrowest part of the elastic portion 3*b* in a region including both the ends is C, relationships: A>C and B≧C are satisfied. More specifically, the width of the elastic portion 3*b* is maximum at the end on the connecting portion 3*a* side.

Preferably, as shown in FIG. 2A, a relationship: B>C is satisfied. More specifically, the elastic portion 3*b* has a part narrower than both the ends at an intermediate position. Thus, it is preferable that the elastic portion 3*b* of the spring member 3 has a constricted shape in which both edges in a width direction are curved in a concave shape.

The function of the support mechanism 1 will be described by way of an example. The color cathode-ray tube used herein had a diagonal size of a screen of 36 inches (86 cm). The pitch in a horizontal direction of the apertures hereinafter, referred to as an "aperture pitch") of the shadow mask 4*a* was 0.58 mm. The frame 4*b* of the shadow mask structure 4 had a size of 50 mm in a tube axis direction, and the thickness of the members was 1.8 mm. The total weight of the shadow mask structure 4 was 4 kg. Such a color cathode-ray tube was subjected to a drop impact test.

The color displacement allowance (allowable shift amount from a reference position of a spot position of an electron beam, at the center of an aperture-formed region of the shadow mask) of the color cathode-ray tube with an aperture pitch of 0.58 mm is about 40 μm. This allowance includes the allowance of landing position deviation of an electron beam attributable to thermal expansion and geomagnetism, as well as the allowance of landing position deviation of an electron beam attributable to the mask position deviation caused by an external impact. Herein, the allowance of position deviation caused by an external impact is preferably less than 20 μm, and more preferably 15 μm or less. The main factor causing the color displacement with an external impact is plastic deformation of the spring member 3.

The drop impact test was performed by applying an impact of a maximum acceleration of 20 G parallel to a long side direction of a screen to the color cathode-ray tube, and measuring the amount of a change in landing position of an electron beam at the center of the screen before and after the application of the impact.

Figure 3:
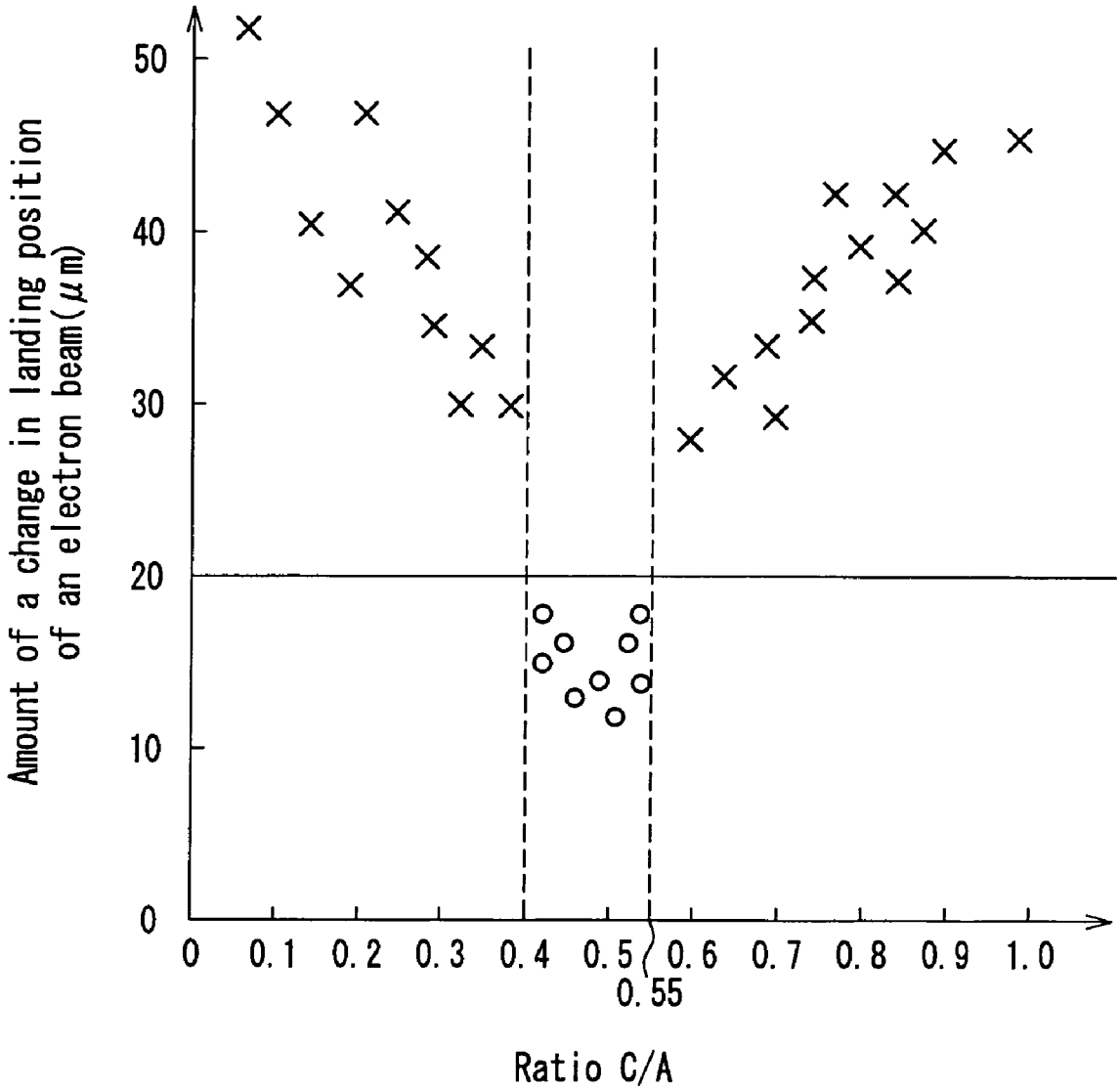
FIG. 3 is a diagram showing the amount of a change in landing position of an electron beam when a drop impact test is performed with a width ratio C/A of an elastic portion of the support mechanism varied.

Regarding the support mechanism 1 used, as shown in FIG. 2B, a height E of the guide portion 2*a* of the base member 2 was set to be 10 mm, a height F of the guide portion 3*e* of the spring member 3 was set to be 5 mm, and an overlap amount G in a height direction between the guide portion 2*a* of the base member 2 and the guide portion 3*e* of the spring member 3 (n a stationary state where the shadow mask structure 4 was mounted on the panel 5) was set to be 4 mm. As the overlap amount G becomes larger, it is more advantageous to an external impact. However, when the height E of the guide portion 2*a* exceeds 10 mm, the guide portion 2*a* is likely to damage an inner wall of the panel 5 when the shadow mask structure 4 is attached or detached with respect to the stud pins 6 in the course of producing the color cathode-ray tube. Furthermore, when the height F of the guide portion 3*e* exceeds 5 mm, the guide portion 3*a* and the base portion 2*b* are likely to bump into each other when the shadow mask structure 4 is attached or detached with respect to the stud pins 6, which makes it difficult to attach or detach the shadow mask structure 4. Color cathode-ray tubes were produced in such a manner that the widths A, B, and C of the spring member 3 satisfied the relationships: A>C and B≧C, with the ratio C/A varied, and each color cathode-ray tube was subjected to a drop impact test. FIG. 3 shows the results.

The following is understood from FIG. 3. In the case where the ratio C/A satisfies a relationship: 0.40<C/A<0.55 (represented by a symbol "○" in FIG. 3), the above-mentioned condition "the amount of a change in landing position of an electron beam caused by an external impact is less than 20 μm" is satisfied, and in the case where the ratio C/A is out of the above-mentioned numerical value range (represented by a symbol "x" in FIG. 3), the above condition is not satisfied.

The reason why the ratio C/A has a large effect on impact resistance is considered as follows. When an external impact is applied to the color cathode-ray tube, the stress caused by the external impact is applied to the spring member 3, in addition to the stress applied thereto in the stationary state. At this time, the elastic portion 3*b* is away from the engagement hole 3*d* that is to be a point of pressure, and a moment amount is increased, so that the elastic portion 3*b* is most likely to be deformed plastically. In the case where the ratio C/A≧0.55, that is, in the case where there is no large difference between the width A of the end of the elastic portion 3*b* on the connecting portion 3*a* side and the width C of the narrowest part of the elastic portion 3*b*, a stress is concentrated on the end of the elastic portion 3*b* on the connecting portion 3*a* side, whereby the elastic portion 3*b* is deformed plastically. Furthermore, in the case where the ratio C/A≦0.40, that is, in the case where the width C of the narrowest part of the elastic portion 3*b* is extremely smaller than the width A of the end of the elastic portion 3*b* on the connecting portion 3*a* side, a stress is concentrated in the narrowest part, whereby the elastic portion 3*b* is deformed plastically. Thus, in the case where the relationship: 0.40<C/A<0.55 is satisfied, the stress added to be applied to the elastic portion 3*b* due to the external impact can be dispersed, and the plastic deformation of the elastic portion 3*b* can be reduced.

Embodiment 2

Embodiment 2 is the same as Embodiment 1, except that a flexural height D of the elastic portion 3*b* of the spring member 3 is 12.5 mm or more. Herein, the flexural height D refers to a displacement amount of the connecting portion 3*a* with respect to the engagement portion 3*c* in a direction normal to the principal plane of the engagement portion 3*c* in a stationary state where the shadow mask structure 4 is mounted on the panel 5 as shown in FIG. 2B.

A drop impact test was performed with the flexural height D of the elastic portion 3*b* varied. Consequently, in the case where the flexural height D was 12.5 mm or more, the amount of a change in landing position was reduced by about 5 μm on average, compared with the case where the flexural height D was less than 12.5 mm.

By setting the flexural height D of the elastic portion 3*b* to be 12.5 mm or more, the torsional rigidity of the spring member 3 is reduced. Therefore, the impact force applied to the spring member 3 under the application of an external impact to the color cathode-ray tube can be reduced, and consequently, the amount of plastic deformation of the spring member 3 can be reduced further.

Embodiment 3

Figure 4:
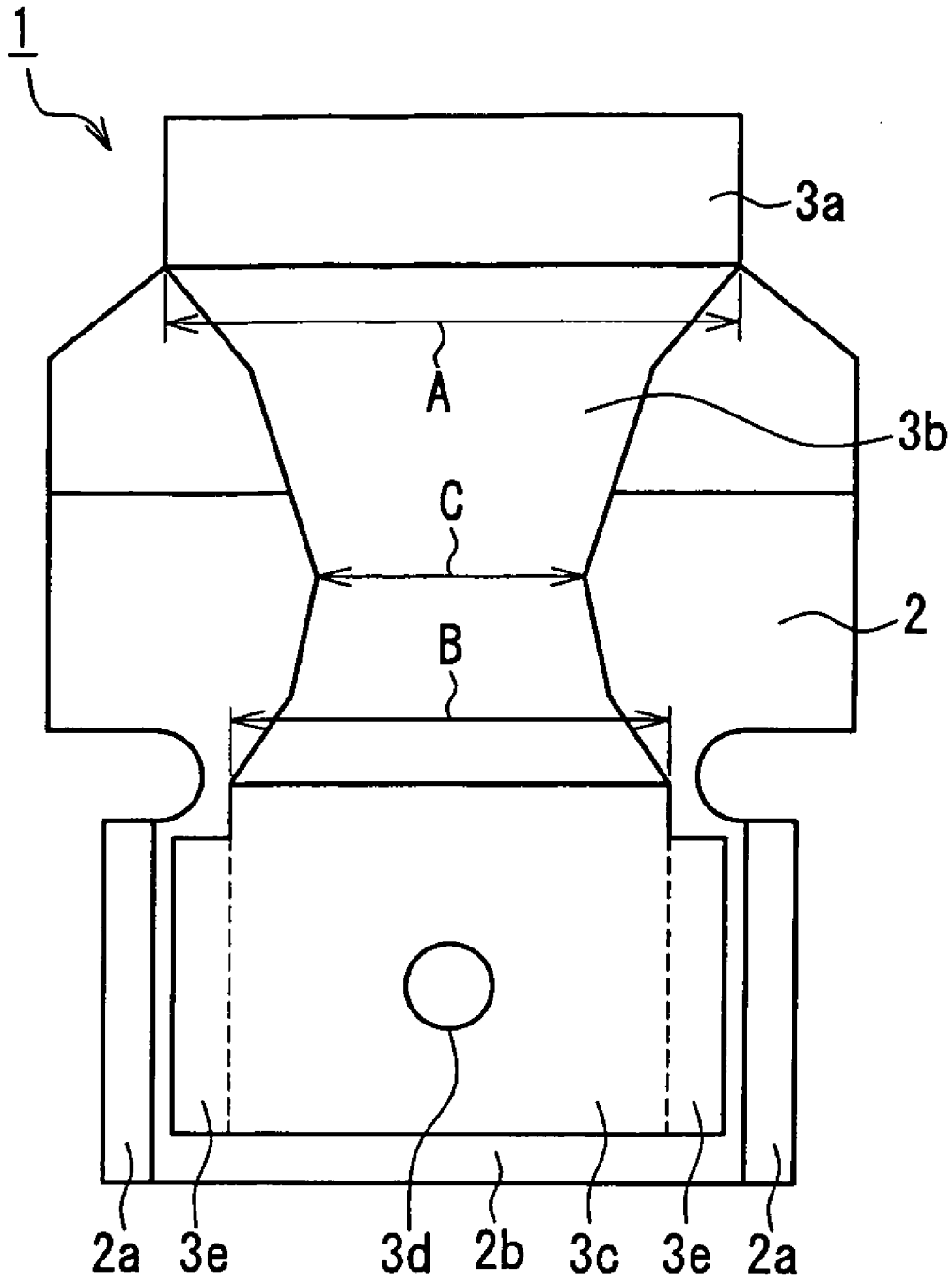
FIG. 4 is an enlarged front view of a support mechanism of a color cathode-ray tube according to Embodiment 3 of the present invention.

Embodiment 3 is different from Embodiment 1 in the following point. In Embodiment 3, as shown in FIG. 4, both edges in a width direction of the elastic portion 3*b* of the spring member 3 are composed of a plurality of straight lines connected to each other at a predetermined angle, whereas in Embodiment 1, both the edges in the width direction are composed of a smoothly curved line.

The present embodiment is the same as Embodiment 1 except for the above, and has the same effect as that of Embodiment 1.

Embodiment 4

Figure 5:
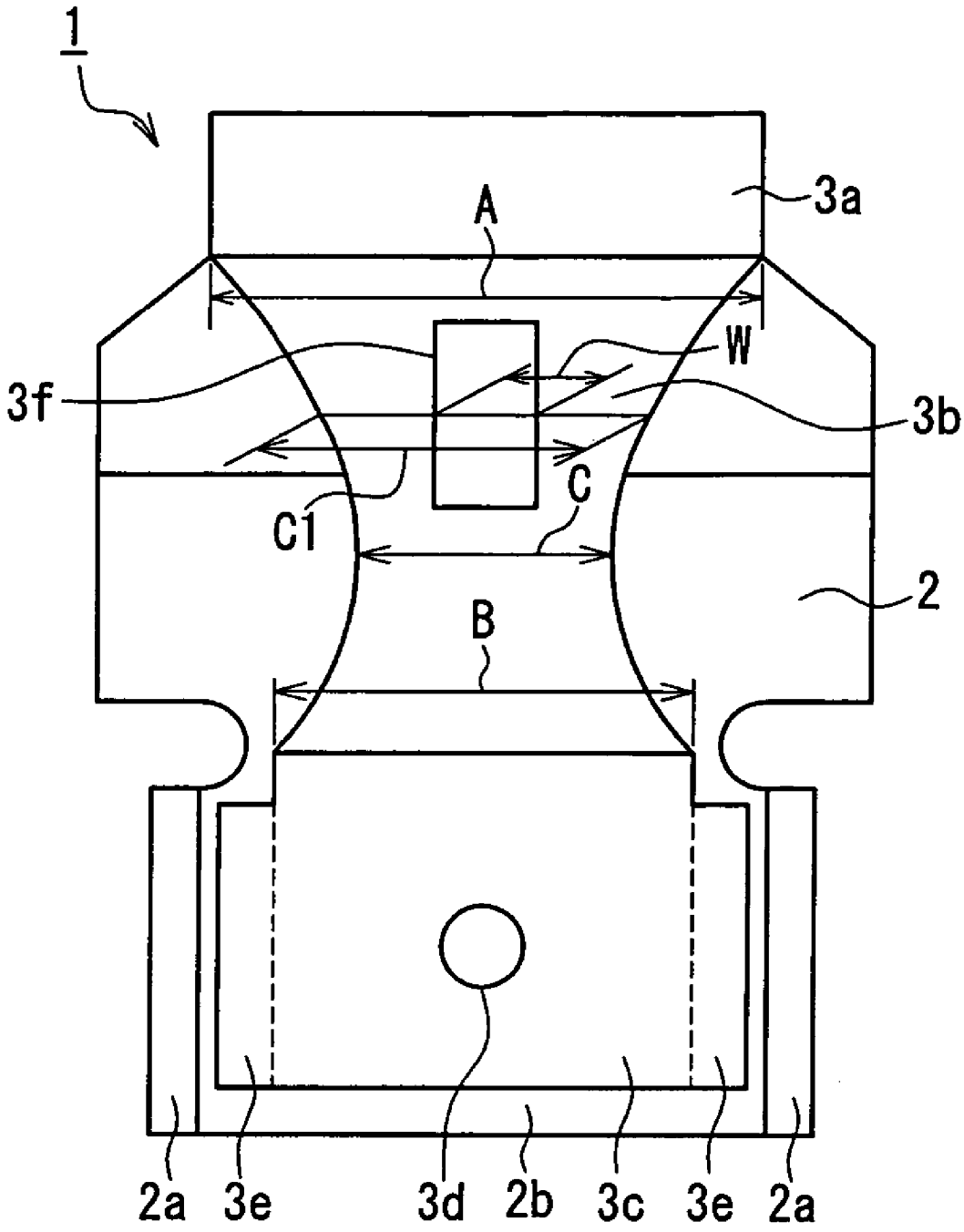
FIG. 5 is an enlarged front view of a support mechanism of a color cathode-ray tube according to Embodiment 4 of the present invention.

Embodiment 4 is different from Embodiment 1 in that a hole 3*f* is provided in the elastic portion 3*b* as shown in FIG. 5.

When the hole 3*f* is provided in the elastic portion 3*b*, the mechanical characteristics such as rigidity of the elastic portion 3*b* are changed. Thus, the effective width of the elastic portion 3*b* in view of the size of the hole 3*f* is considered. That is, as shown in FIG. 5, assuming that the external size (interval between both the edges in the width direction) of the elastic portion 3*b* is $C_1$ and the width of the hole 3*f* at that point is W, the effective width of the elastic portion 3*b* is defined by $C_1-W$. At the point where the hole 3*f* is not formed, W=0, so that the effective width of the elastic portion 3*b* is matched with the external size $C_1$.

In the case where the hole 3*f* is provided in the elastic portion 3*b* as in the present embodiment, assuming that the minimum value of the external size of the elastic portion 3*b* (i.e., the width in the narrowest part) is C, and the minimum value of the effective width of the elastic portion 3*b* is C', it is necessary that relationships: A>C and B≧C and 0.40<C'/A<0.55 are satisfied. It is preferable that the relationship: B>C is satisfied, as shown in FIG. 5.

In the case where the hole 3*f* is not formed as in the elastic portion 3*b* described in Embodiment 1 (W=0), a relationship: C'=C is satisfied. Therefore, it is necessary that the relationships: A>C and B≧C and 0.40<C/A<0.55 are satisfied, as described in Embodiment 1.

Embodiment 5

Figure 6B:
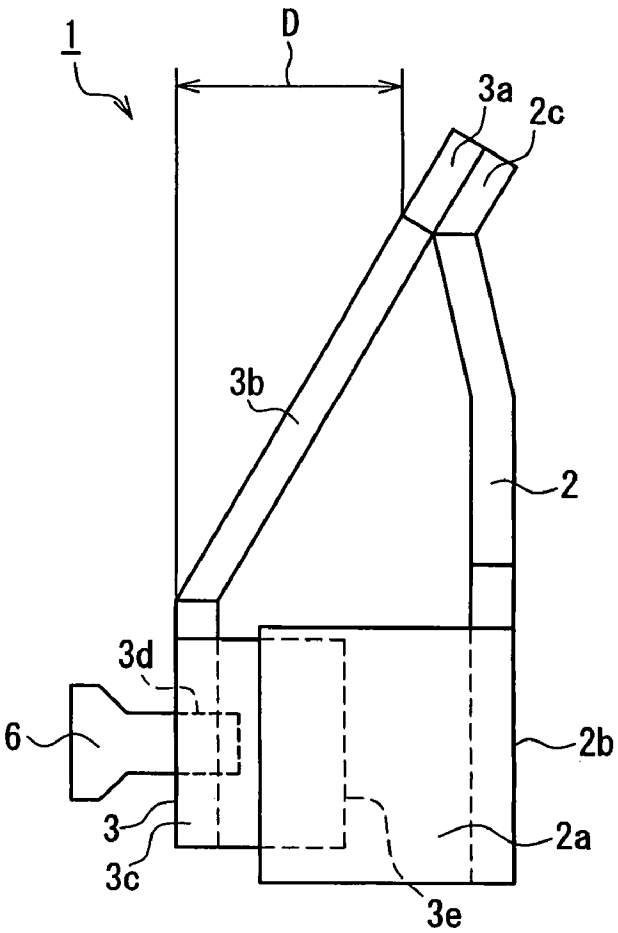
FIG. 6B is an enlarged side view thereof.
Figure 6A:
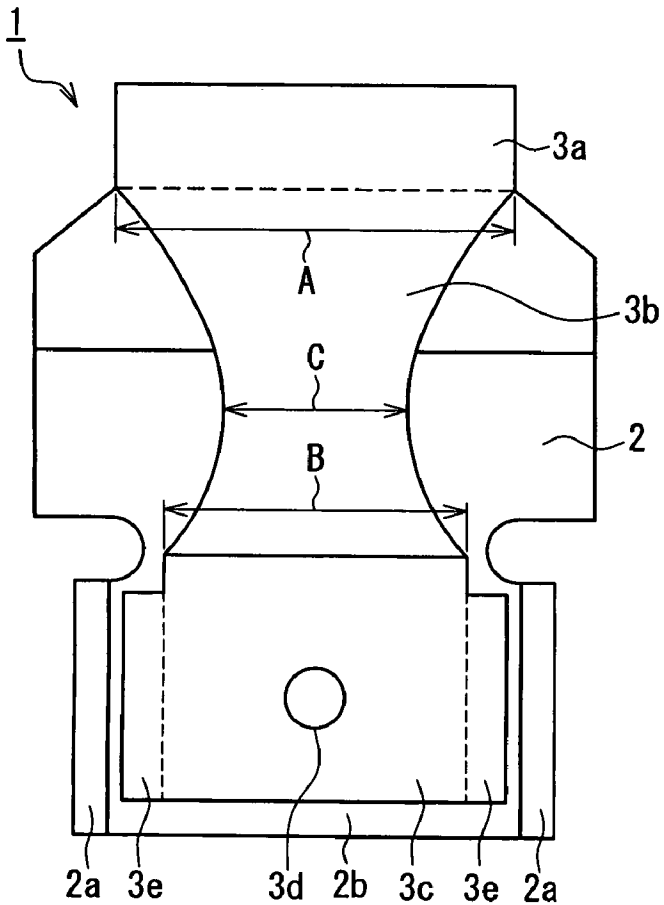
FIG. 6A is an enlarged front view of a support mechanism of a color cathode-ray tube according to Embodiment 5 of the present invention.

Embodiment 4 is different from Embodiment 1 in the following point. In Embodiment 4, as shown in FIGS. 6A and 6B, the connecting portion 3*a* and the elastic portion 3*b* of the spring member 3 are substantially co-planar, whereas in Embodiment 1, the elastic portion 3*b* is bent with respect to the connecting portion 3*a*.

In the present embodiment, a part of the spring member 3 in contact with the base member 2 is determined to be the connecting portion 3*a*, and a part of the spring member 3 not in contact with the base member 2 is determined to be the elastic portion 3*b*. Under this condition, the width A of the end of the elastic portion 3*b* on the connecting portion 3*a* side is determined. In the present embodiment, the widths A, B, and C satisfy the condition described in Embodiment 1, whereby the same effect as that described in Embodiment 1 is exhibited.

Embodiment 6

Figure 7:
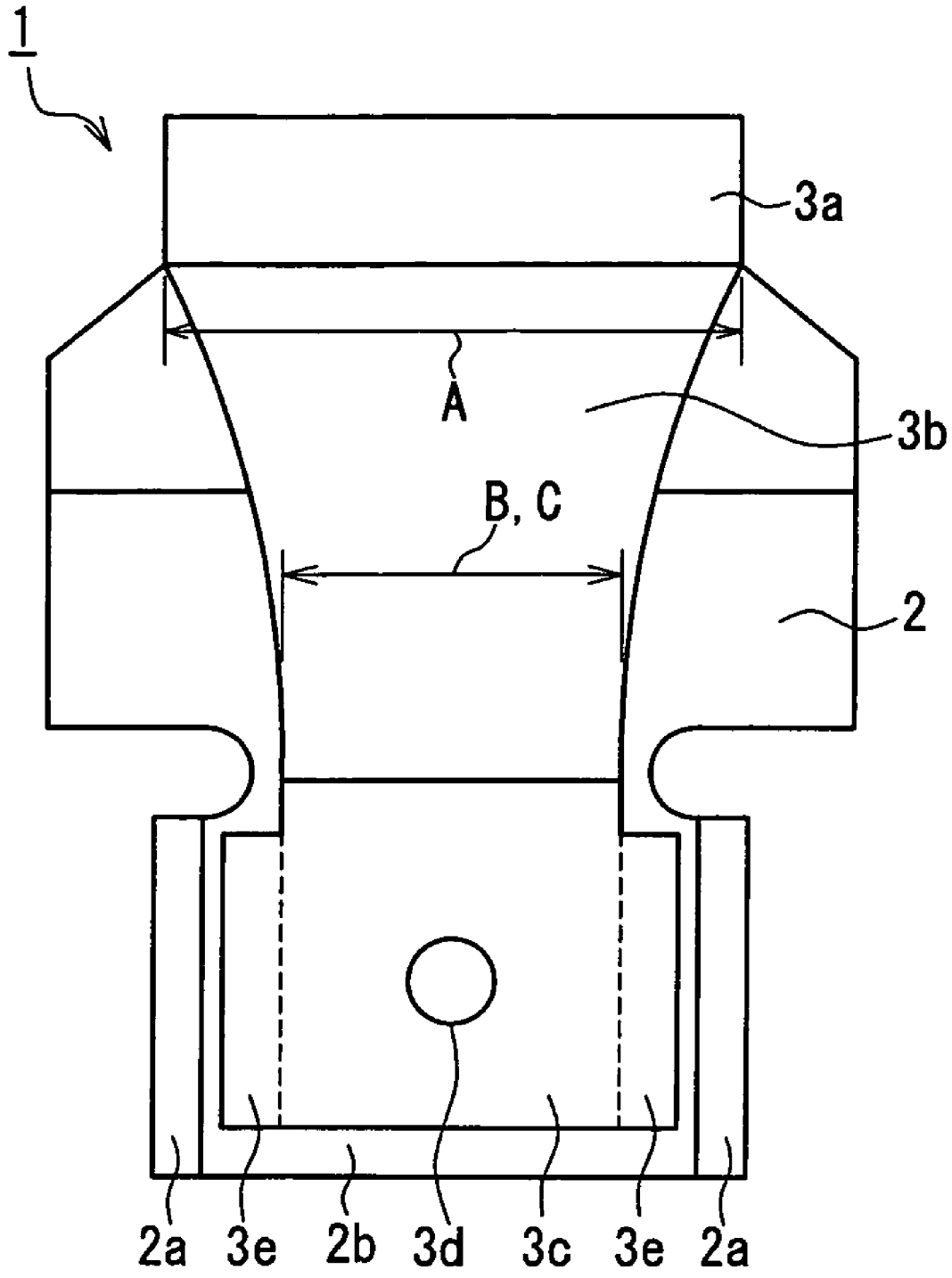
FIG. 7 is an enlarged front view of a support mechanism of a color cathode-ray tube according to Embodiment 6 of the present invention.

Embodiment 6 is different from Embodiment 1 in the following point. In Embodiment 6, as shown in FIG. 7, the narrowest part of the elastic portion 3*b* is placed at the end on the engagement portion 3*c* side, whereas in Embodiment 1, the narrowest part of the elastic portion 3*b* is placed in a region excluding the end on the connecting-portion 3*a* side and the end on the engagement portion 3*c* side. Thus, in the present embodiment, a relationship: B=C is satisfied.

As in the present embodiment, if the width of the elastic portion 3*b* is minimum at the end on the engagement portion 3*c* side, the stress added to be applied to the elastic portion 3*b* due to an external impact can be dispersed most satisfactorily, so that impact resistance is enhanced.

However, when the width of the elastic portion 3*b* is minimum at the end on the engagement portion 3*c* side, the following problem may arise. In the course of producing the color cathode-ray tube, when the shadow mask structure 4 is attached or detached with respect to the stud pins 6 fixed on the panel 5, the force toward the base portion 2*b* side is applied to the engagement portion 3*c* with a substantially U-shaped member, whereby the support mechanism 1 is deformed elastically. When the width of the elastic portion 3*b* is minimum on the engagement portion 3*c* side, the width of the engagement portion 3*c* also becomes narrow. Therefore, the substantially U-shaped member bumps into the circumferential end of the engagement portion 3*c*, and/or it becomes difficult to press the engagement portion 3*c* satisfactorily.

Thus, considering the workability in the course of producing the color cathode-ray tube, it is preferable that the relationship: B>C is satisfied as shown in FIG. 2A.

In the above-mentioned Embodiments 1 to 6, the case where the elastic portion 3*b* of the spring member 3 is a flat plate forming one plane has been described. As long as the base member 2 and the spring member 3 are connected to each other so as to form a substantially V-shape as a whole, for example, the elastic portion 3*b* may be bent at one or more places, and the elastic portion 3*b* may be curved in an arc shape.

Furthermore, the support mechanisms 1 are provided at four corners of the shadow mask structure 4. However, as long as the shadow mask structure 4 can be held stably, the support mechanism 1 may be provided at a place other than the four corners. Furthermore, the number of the support mechanisms 1 to be used is not limited to four.

As the color selection electrode, the example using the shadow mask has been described. However, for example, a so-called aperture grill having slit-shaped apertures also may be used.

Furthermore, the case where the shadow mask structure 4 with the shadow mask stretched in a flat plate shape so as to flatten a screen has been described. However, a shadow mask structure provided with a known shadow mask formed in a dome shape by pressing or the like may be used.

Furthermore, as the frame holding the shadow mask, the substantially rectangular frame is used. However, a frame may be used that is obtained by welding a long frame having a cross section in a triangular shape, an L-shape, or the like to a short frame having a cross section in a substantially U-shape or the like, in a substantially rectangular shape.

The applicable field of the color cathode-ray tube of the present invention is not particularly limited, and the color cathode-ray tube can be used for a TV receiver and a computer monitor.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube, comprising:

a panel in which a phosphor surface is formed on an inner surface and a stud pin is fixed;

a funnel connected to the panel;

a shadow mask structure placed so as to be opposed to the phosphor surface; and a support mechanism for engaging the shadow mask structure with the stud pin, wherein the support mechanism includes a base member and a spring member connected to each other in a substantially V-shape, the spring member includes a connecting portion connected to the base member, an engagement portion having an engagement hole in which the stud pin is fitted, and an elastic portion between the connecting portion and the engagement portion, tilted with respect to the base member and mainly having a spring function, assuming that a width of an end of the elastic portion on the connecting portion side is A, a width of an end of the elastic portion on the engagement portion side is B, a width of a narrowest part of the elastic portion in a region including both the ends is C, and a minimum value of an effective width of the elastic portion in the region including both the ends is C', relationships: A>C and B≧C, and 0.40<C'/A<0.55 are satisfied, and the base member includes a base portion welded to the shadow mask structure, and a second connecting portion welded to the connecting portion of the spring member.

2. The color cathode-ray tube according to claim 1, wherein a relationship: B>C is satisfied.

3. The color cathode-ray tube according to claim 1, wherein, in a state where the shadow mask structure is mounted on the panel, a flexural height D of the elastic portion of the spring member is 12.5 mm or more.

4. The color cathode-ray tube according to claim 2, wherein, in a state where the shadow mask structure is mounted on the panel, a flexural height D of the elastic portion of the spring member is 12.5 mm or more.

* * * * *